US012065285B2

(12) United States Patent
Gothelf

(10) Patent No.: US 12,065,285 B2
(45) Date of Patent: Aug. 20, 2024

(54) SHRINK WRAP SECURITY SEAL FOR CONTAINER

(71) Applicant: Morton Bassett, LP, Rohnert Park, CA (US)

(72) Inventor: Rodney Gothelf, Novato, CA (US)

(73) Assignee: MORTON BASSETT, LP, Rohnert Park, CA (US)

( * ) Notice: Subject to any disclaimer, the term of this patent is extended or adjusted under 35 U.S.C. 154(b) by 375 days.

(21) Appl. No.: 17/655,754

(22) Filed: Mar. 21, 2022

(65) Prior Publication Data

US 2023/0294876 A1 Sep. 21, 2023

(51) Int. Cl.
*B65D 23/08* (2006.01)
*B65D 55/06* (2006.01)
*B65D 75/00* (2006.01)

(52) U.S. Cl.
CPC ..... *B65D 23/0878* (2013.01); *B65D 55/066* (2013.01); *B65D 75/002* (2013.01)

(58) Field of Classification Search
CPC ..... B65D 23/0878; B65D 55/066; B65D 75/002; B65D 2251/0015; B65D 2251/0056; B65D 2251/0093; B65D 51/20; B65D 55/0854
See application file for complete search history.

(56) References Cited

U.S. PATENT DOCUMENTS

2005/0205513 A1* 9/2005 Hidding ..... B65D 1/023 215/246

* cited by examiner

*Primary Examiner* — Daniel H Lee
(74) *Attorney, Agent, or Firm* — Kwan & Olynick LLP

(57) ABSTRACT

In some embodiments, a container includes a cover placed on the container. Shrinkable material that is placed on the container where the shrinkable material is shrunk around the container and the cover. The shrinkable material includes a tamper indicator. A cap is placed over the shrinkable material where the cap covers the shrinkable material such that the shrinkable material is not shown below the cap.

20 Claims, 5 Drawing Sheets

SHRINK WRAP SECURITY SEAL FOR CONTAINER

BACKGROUND

A bottle, such as a bottle to hold spices, may be sealed with a tamper-proof seal. If someone tampers with the seal, the seal may break such that a user can determine that someone may have tampered with the bottle. Different types of seals may be used. For example, an induction seal may be used to place a lining on the rim of a bottle. The lining may be sealed to the glass bottle using an induction process that melts some of the bottle surface to the lining. When a plastic bottle is used, the induction seal welds the lining to the plastic container by melting a small amount of the plastic surface of the bottle to adhere the lining to the plastic bottle. However, when a glass bottle is used, the glass cannot be melted by the induction process to form an induction seal. A thin coating on the glass bottle may be used to coat the glass, and the coating melts to create the seal with the lining when the induction process is performed. The seal that results on the glass bottle may not be optimal, and it may not be fully tamper-proof. For example, the lining may come off when a consumer buys the bottle and twists the cap. Someone may not have tampered with the bottle, but the seal is defective and has come off causing the consumer to possibly think that someone may have tampered with the bottle.

Also, a shrink wrap seal may be placed over the cover of the bottle. The shrink wrap may include a perforation that breaks when the cover of the bottle is removed. However, sometimes the cover can be unscrewed without breaking the shrink wrap seal. Then, someone can tamper with the bottle and the cap can then be screwed back on without showing evidence of the tampering on the shrink wrap. This is because the cap has a larger diameter than the bottle neck and the shrink wrap can sometimes be inserted back onto the bottle without breaking the perforation of the shrink wrap.

BRIEF DESCRIPTION OF THE DRAWINGS

With respect to the discussion to follow and to the drawings, it is stressed that the particulars shown represent examples for purposes of illustrative discussion, and are presented to provide a description of principles and conceptual aspects of the present disclosure. In this regard, no attempt is made to show implementation details beyond what is needed for a fundamental understanding of the present disclosure. The discussion to follow, in conjunction with the drawings, makes apparent to those of skill in the art how embodiments in accordance with the present disclosure may be practiced. Similar or same reference numbers may be used to identify or otherwise refer to similar or same elements in the various drawings and supporting descriptions. In the accompanying drawings.

DETAILED DESCRIPTION

Described herein are techniques for a container system. In the following description, for purposes of explanation, numerous examples and specific details are set forth to provide a thorough understanding of some embodiments. Some embodiments as defined by the claims may include some or all the features in these examples alone or in combination with other features described below, and may further include modifications and equivalents of the features and concepts described herein.

A container, such as a bottle, may be sealed using a shrinkable material, such as a shrink wrap seal. However, instead of placing the shrink wrap seal over the cap of the bottle, the shrink wrap seal may be placed under the cap of the bottle. Placing the shrink wrap seal under the cap may improve a tamper indication feature of the shrink wrap because the shrink wrap is over the opening of the bottle and not over the cap. The cap has a larger diameter than the opening and the shrink wrap can be fitted around the container more tightly when placed under the cap and on the container. Also, the shrink wrap may be positioned to be covered by the cap when the cap is attached to the bottle. The covering of the shrink wrap may provide a look and feel of the bottle and cap assembly that is more desirable than having the shrink wrap on top of the cap because a user cannot see the shrink wrap when the bottle is displayed, such as for a sale or demonstration. A manufacturing system may use aligners to align the shrink wrap in a desired position such that the shrink wrap is shrunk around the container in the right position.

Container Overview

Figure 1:
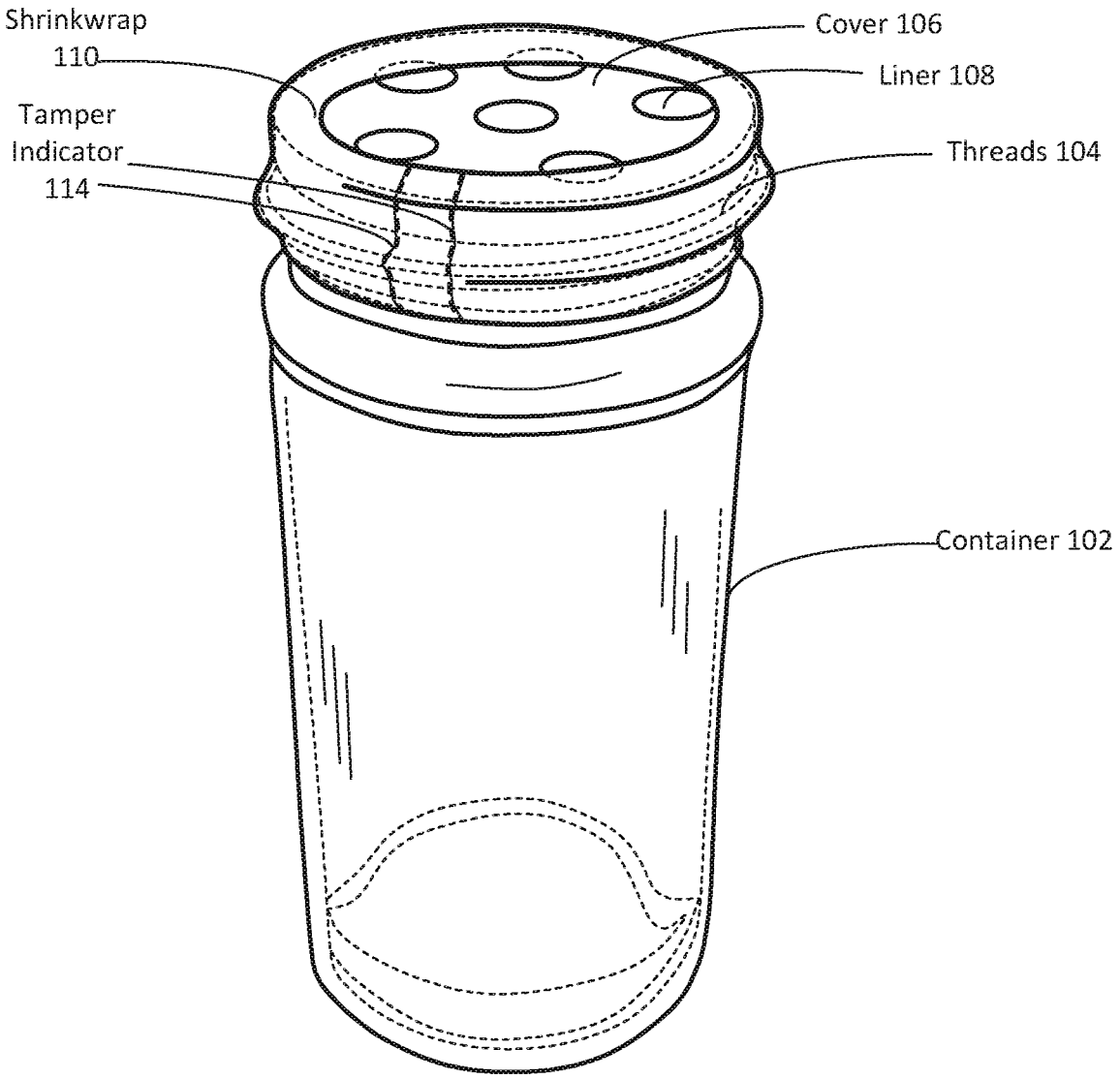
FIG. 1 depicts an example of a container with a shrink wrap seal according to some embodiments.
Figure 2:
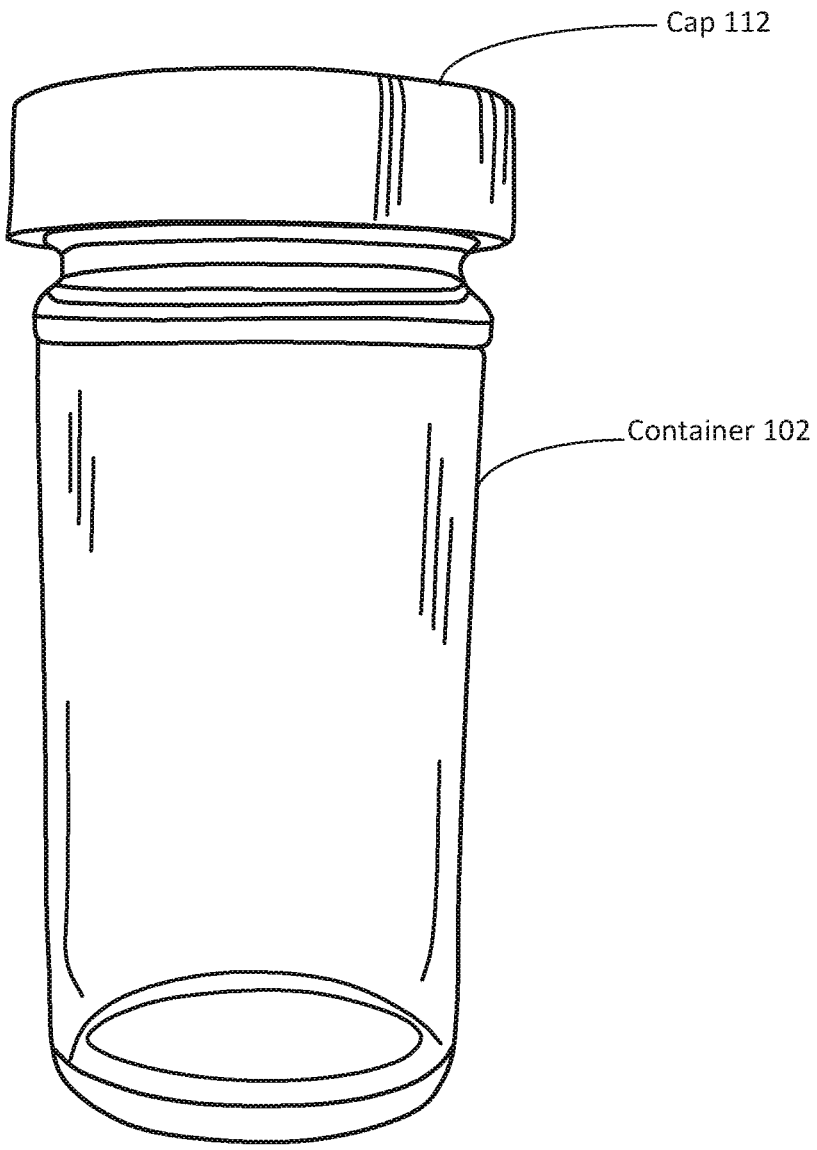
FIG. 2 an example of the container with a cap over the shrink wrap seal according to some embodiments.
Figure 3:
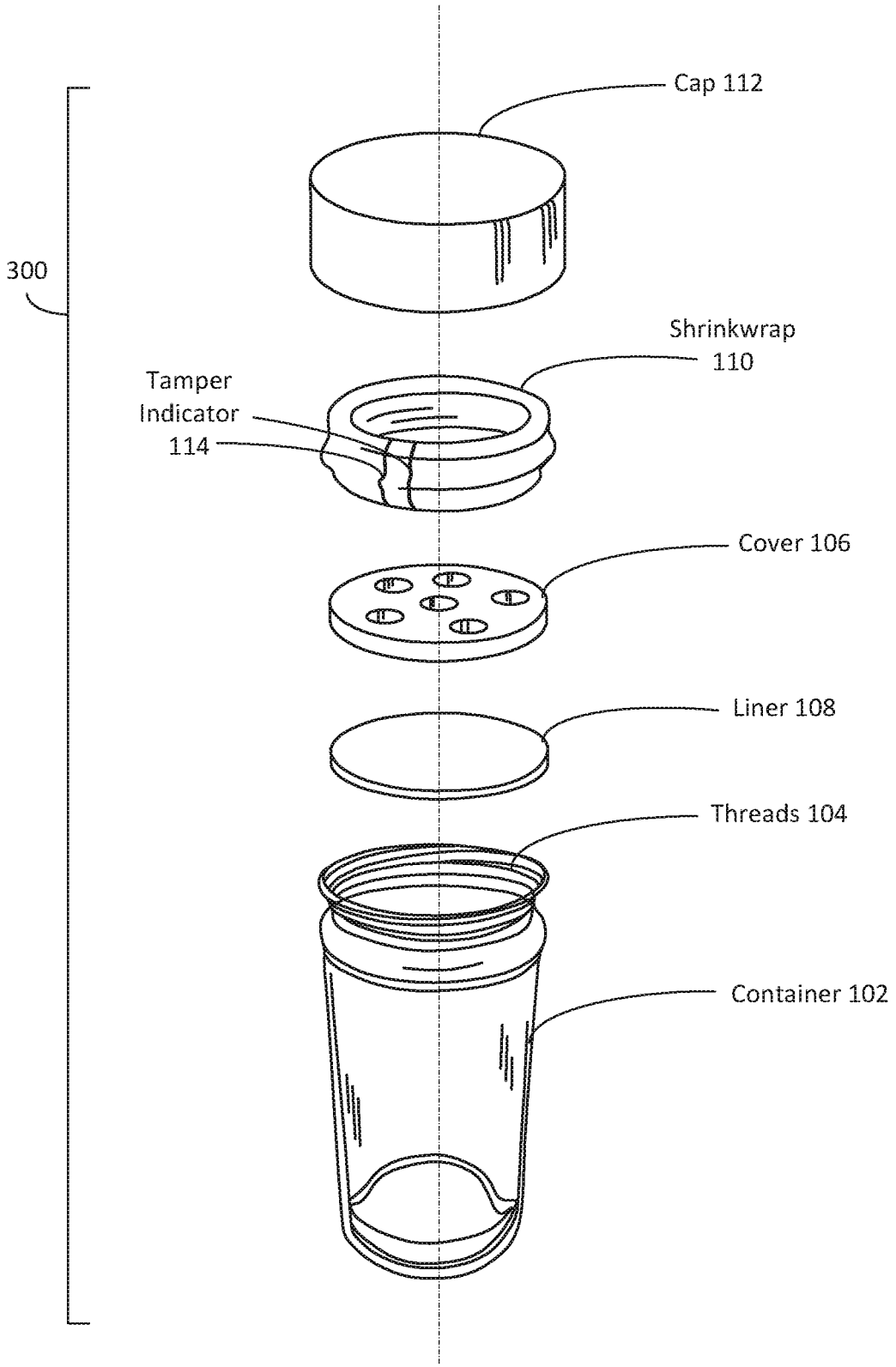
FIG. 3 depicts an exploded view of the container with the shrink wrap seal and a cap according to some embodiments.

FIGS. 1-3 depict a container system according to some embodiments. FIG. 1 depicts an example of a container 102 with a shrink wrap seal 110 according to some embodiments. FIG. 2 an example of container 102 with a cap 112 over shrink wrap seal 110 according to some embodiments. FIG. 3 depicts an exploded view of container 102 according to some embodiments.

Container 102 may be configured to hold an item, such as spices, food, or other objects. Container 102 may be made of a material that is hard and breakable, such as glass. In some embodiments, container 102 is a bottle, such as a glass bottle. Also, in some embodiments, container 102 is not plastic. Glass is made from sand. During the process of glass making, sand is mixed with other materials and then all the materials are heated together until they form an amorphous material. When this product cools, it forms glass. Plastic is usually made from petroleum oils or other organic materials. Glass is not malleable, and plastic is malleable. When applying a certain amount of heat to container 102 to produce a seal, such as using an induction seal process, the material of container 102 may not melt unlike a plastic container.

Container 102 may include an opening in a neck area in which items can be inserted, such as spices. The bottom part of container 102 may be closed. The neck area includes threads 104, which may be protrusions, such as ridges. Threads 104 may be used to secure a cap 112 onto the neck area of container 102. Cap 112 may also include threads (not shown). Threads 104 and the threads on container 102 may be different patterns, such as male and female threads, that lock together to secure cap 112 to container 102 with a turning motion.

The opening of container 102 includes a rim on the top on container 102. A dispensing cover 106 is configured to be placed on the rim. Dispensing cover 106 may be secured to the rim. For example, dispensing cover 106 may snap onto the rim. An outside surface of dispensing cover 106 may be flush with an outside surface of the neck area of container 102. Threads 104 may protrude past the outside surface of dispensing cover 106. In some embodiments, when container 102 is used to hold an item that can be dispensed, such as spices, dispensing cover 106 may include holes or dispensing areas that the spices in container 102 can be dispensed through.

A liner 108 may be included under the dispensing cover 106. Liner 108 may be placed in between the rim of container 102 and dispensing cover 106. In other embodiments, liner 108 may not be included. Liner 108 may be made of different materials, such as paper.

In some embodiments, when liner 108 is included, liner 108 may be sealed to the rim of the bottle. Different types of sealing processes may be used. For example, an induction seal may be used, which applies a heat to the liner and bottle using an electromagnetic induction device. Induction sealing is a process of bonding thermoplastic materials by induction heating. An induction sealing machine controls heating of an electrically conducting object by electromagnetic induction, through heat generated in the object by eddy currents. The induction seal may melt a substance on liner 108, which seals liner 108 to the rim of container 102. However, an induction seal may not be needed because another security seal of shrink wrap seal 110 is used, which will be described later. In this case, liner 108 may be a freshness seal that covers the bottle and keeps the contents of the bottle fresh and the contents may not leak when the cap is removed. By not having to use any type of seal on liner 108, costs may be saved in using a sealant for liner 108 and also equipment to seal liner 108.

Shrink wrap seal 110 may be made of a shrinkable material when heat is applied. The material may be plastic and may be referred to as shrink wrap. Other shrinkable materials may be used. Shrink wrap seal 110 is placed over dispensing cover 106 and the neck of container 102. Shrink wrap seal 110 may also cover at least a portion of the threads of the bottle. In some embodiments, shrink wrap seal 110 may not fully cover a top of dispensing cover 106 leaving an open hole on top of dispensing cover 106. However, shrink wrap seal 110 may fully cover liner 108. Some holes on dispensing cover 106 may be covered by shrink wrap seal 110 and some holes may not be covered by shrink wrap seal 110. However, liner 108 may block the holes to not allow the contents of the bottle to leak through the holes. In this case, shrink wrap seal 110 may not need to fully cover liner 108 because the contents of container 102 are blocked by liner 108 from leaking out of container 102. Not fully covering liner 108 may allow shrink wrap seal 110 to use a single rectangular strip that is placed around container 102. The width of the shrink wrap may be based on positioning the bottom of the shrink wrap such that it does not show when the cap is screwed on the bottle. This simplifies the placement and shrinking of shrink wrap seal 110, which will be discussed in more detail below.

Shrink wrap seal 110 may be a tamper proof security seal that includes a tampering indicator 114. Tampering indicator 114 may indicate when tampering may have occurred. For example, if shrink wrap seal 110 is tampered with, such as removed from container 102, tampering indicator 114 may be activated. The activation may indicate someone may have tampered with container 102. In some embodiments, tampering indicator 114 may be a perforation or perforations in the shrink wrap that may break if shrink wrap seal 110 is moved a certain amount or is removed from container 102. In some examples, tampering indicator 114 forms two perforations in shrink wrap seal 110, but any number of perforations may be used. When shrink wrap seal 110 is removed or moved, the perforations may tear apart splitting shrink wrap seal 110. For example, the perforation breaks if shrink wrap seal 110 is removed from container 102. The breaking of the perforation causes shrink wrap seal 110 to break at the perforation points. Shrink wrap seal 110 is then not securely wrapped around container 102.

As shown in FIG. 2, container 102 includes a cap 112 that can be placed over shrink wrap seal 110. When shrink wrap seal 110 is removed from container 102, tampering indicator 114 is activated (e.g., broken). The activation may occur because shrink wrap seal 110 is shrunk around the outside of container 102. This is different from when shrink wrap seal 110 is applied over cap 112 because the top of shrink wrap seal 110 that is over cap 112 may have had a larger circumference than container 102 allowing shrink wrap seal 110 to be removed without activating tampering indicator 114.

Cap 112 is configured to screw on to threads 104 of container 102. Cap 112 may cover shrink wrap seal 110 such that shrink wrap seal 110 may not be seen without removing cap 112. This improves the look and feel of the bottle.

The threads of cap 112 and threads 104 of container 102 may be configured such that cap 112 can be screwed onto container 102 without activating tampering indicator 114. For example, threads 104 may be coarse and continuous. The coarse fit may loosely lock cap 112 onto container 102. A finer fit of threads may more tightly lock cap 112 onto container 102, but may break tampering indicator 114. For example, the finer fit may catch and break the perforations of shrink wrap seal 110. The coarse fit may not break the perforations when cap 112 is screwed onto container 102. The continuous threads do not have a break in them. A break may cause shrink wrap seal 110 to get caught on cap 112 when screwing or unscrewing cap 112 onto container 102. The continuous threads allow cap 112 to be screwed onto container 102 and unscrewed from container 102 without activating tampering indicator 114. Also, cap 112 is configured to not contact the end of shrink wrap seal 110 that is under cap 112 when cap 112 is screwed on and unscrewed. Contacting the end of shrink wrap seal 110 may pull the seal upwards, which may break tampering indicator 114.

Shrink wrap seal 110 may be secured to container 102 and over at least a portion of the threads 104. When sealed, the top part of shrink wrap seal 110 that is covering the opening of container 102 and dispensing cover 106 may substantially have the same circumference as the bottom end of shrink wrap seal 110.

The bottom of shrink wrap seal 110 may end before the end of threads 104 on container 102. This may cause shrink wrap seal 110 to not be visible and also screwing cap 112 onto container 102 may not activate tampering indicator 114. This improves the look and feel of container 102 because shrink wrap seal 110 is not placed over cap 112 and shrink wrap seal 110 is not seen below cap 112. Thus, the bottle may show no signs of having a tamper proof security feature until cap 112 is unscrewed from container 102.

FIG. 3 depicts an exploded view of container 102 with shrink wrap seal 110 and cap 112 according to some embodiments. Cap 112 is placed over shrink wrap seal 110 and covers all of shrink wrap seal 110. Also, shrink wrap seal 110 is between cap 112 and cover 106/liner 108. Liner 108 may have the same diameter as the opening of container 102. Liner 108 is first placed on container 102. Cover 106 may be configured to be secured to the rim of container 102 and has a similar diameter as the opening of container 102. Shrink wrap seal 110 is then placed over cover 106 and liner 108. Finally, cap 112 is screwed onto container 102.

Manufacturing Process

Figure 4:
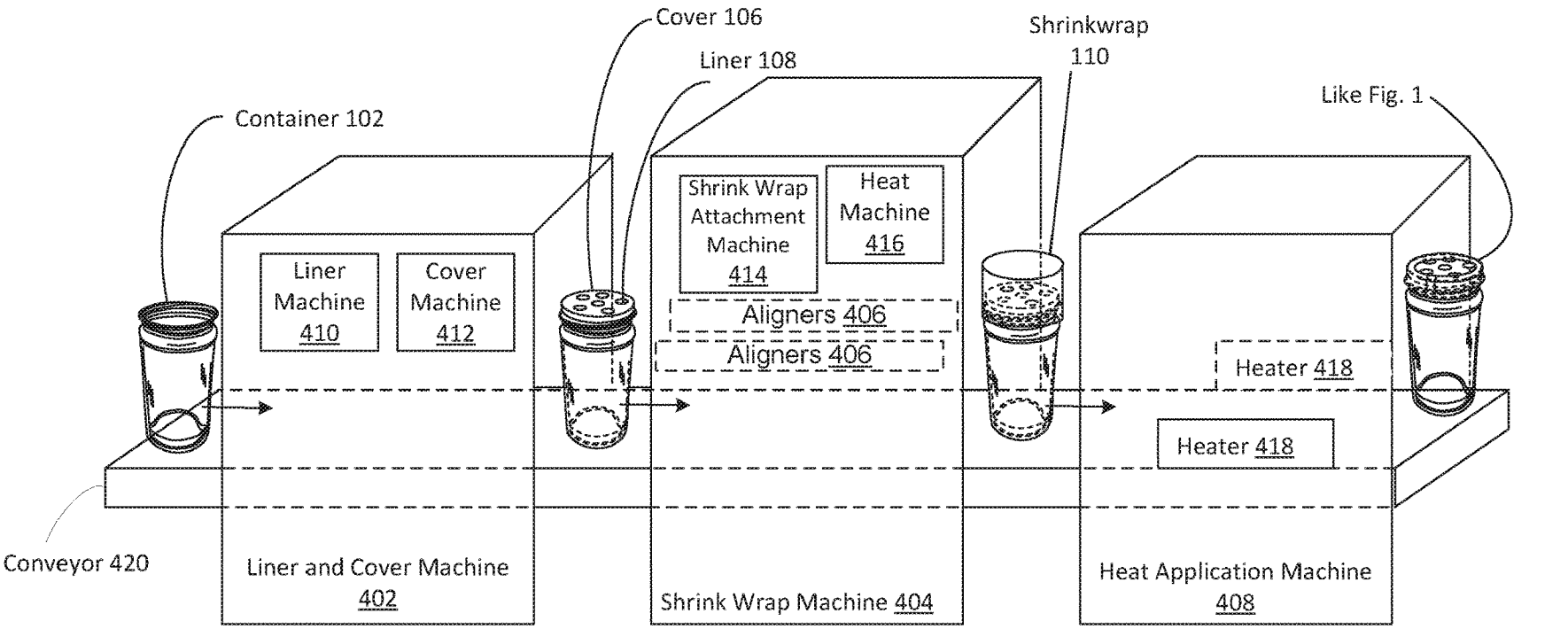
FIG. 4 depicts an example of a manufacturing system for the container system according to some embodiments.

FIG. 4 depicts an example of a manufacturing system 400 for the container system according to some embodiments. Container 102 may be placed on a conveyor belt 420 that moves to transport container 102 through different stages of the manufacturing process. Other methods of moving container 102 may be used. Before entering a liner and cover machine 402, a container 102 is shown with an opening on top of container 102. Container 102 enters liner and cover machine 402 and a liner machine 410 attaches liner 108 to container 102. Liner 108 may not be sealed onto container 102, which simplifies the machinery that is used for liner and cover machine 402. Then, a cover machine 412 attaches cover 106 to container 102. Cover 106 may secure liner 108 to container 102.

After liner and cover machine 402, container 102 proceeds to shrink wrap machine 404. Shrink wrap machine 404 includes aligners 406 that are used to position where shrink wrap is placed on container 102. Aligners 406 may be a structure that limits the positioning of shrink wrap. In some embodiments, aligners 406 may be solid structures, such as guide rails, bands, blocks, or other objects. If bands are used, the bands can move as container 102 moves along the conveyor belt 420 through shrink wrap machine 404.

Aligners 406 have a top portion that can be positioned to contact container 102 at a point that is where a bottom of shrink wrap seal 110 should be placed on container 102. Accordingly, when a shrink wrap attachment machine 414 places shrink wrap seal 110 onto container 102, aligners 406 position shrink wrap seal 110 in a desired position. For example, shrink wrap attachment machine 414 may place a circular shape of shrink wrap seal 110 around container 102. Then, the top of aligners 406 stops the downward motion of shrink wrap seal 110 as shrink wrap seal 110 is inserted over the top of the opening of container 102 and around container 102. Accordingly, shrink wrap attachment machine 414 may attach a cylindrically shaped version of shrink wrap seal 110 in a downward motion that only stops when contacting the top of aligners 406. If aligners 406 were not used, the bottom of shrink wrap seal 110 may stop at a lower point (or higher point) on container 102 and may also stop at inconsistent points on different bottles 102. Using aligners 406 provides an improvement because shrink wrap seal 110 is positioned consistently across multiple bottles 102, and also positioned in a way such that shrink wrap seal 110 is not shown below cap 112.

Shrink wrap attachment machine 414 may loosely place shrink wrap seal 110 around the neck of container 102. Once container 102 leaves shrink wrap machine 404, aligners 406 may not be extended past shrink wrap machine 404. Accordingly, shrink wrap seal 110 may move from the desired positioning, such as shrink wrap seal 110 may move down the neck of container 102 when container 102 leaves shrink wrap machine 404. To overcome this problem, a heat machine 416 may be used to secure shrink wrap seal 110 in place. Heat machine 416 applies heat to a portion of shrink wrap seal 110. For example, heat machine 416 may be a heat gun that can output heat in a targeted area. However, any type of heater may be used. The strength of the heat and the area in which heat is applied may not fully shrink the shrink wrap seal 110 around cover 106. Rather, heat machine 416 is positioned to slightly shrink a bottom portion of shrink wrap seal 110 to secure the bottom of shrink wrap seal 110 around the neck of container 102. Heat machine 416 may not apply heat to another portion of shrink wrap seal 110, such as the top portion such that the top portion is not shrunk. The secures the positioning of shrink wrap seal 110 on container 102. Then, container 102 can continue on conveyor belt 420 without using aligners 406 and shrink wrap seal 110 may not move on container 102.

A heat application machine 408 may fully shrink the shrink wrap seal 110 around container 102. In some embodiments, heat application machine 408 may be a tunnel shape that applies heat to a larger area of container 102. Heaters 418 apply the strength of heat in an area required to fully shrink the shrink wrap seal 110. Heaters 418 may apply more heat than heat machine 416, and apply the heat to a larger area, such as to all of shrink wrap seal 110. Also, heaters 418 in the tunnel may apply heat for a longer length and time compared to heat machine 416, which may only apply a small amount of heat at one position to a smaller area. Accordingly, heaters 418 shrinks more of shrink wrap seal 110 than heat machine 416. Heat application machine 408 is used separately from heat machine 416 because a size of heaters 418 may not fit in shrink wrap machine 404. When container 102 exits heat application machine 408, container 102 is like the container 102 depicted in FIG. 1 where shrink wrap seal 110 has be shrunk around container 102. A cap 112 may then be screwed onto container 102.

Figure 5:
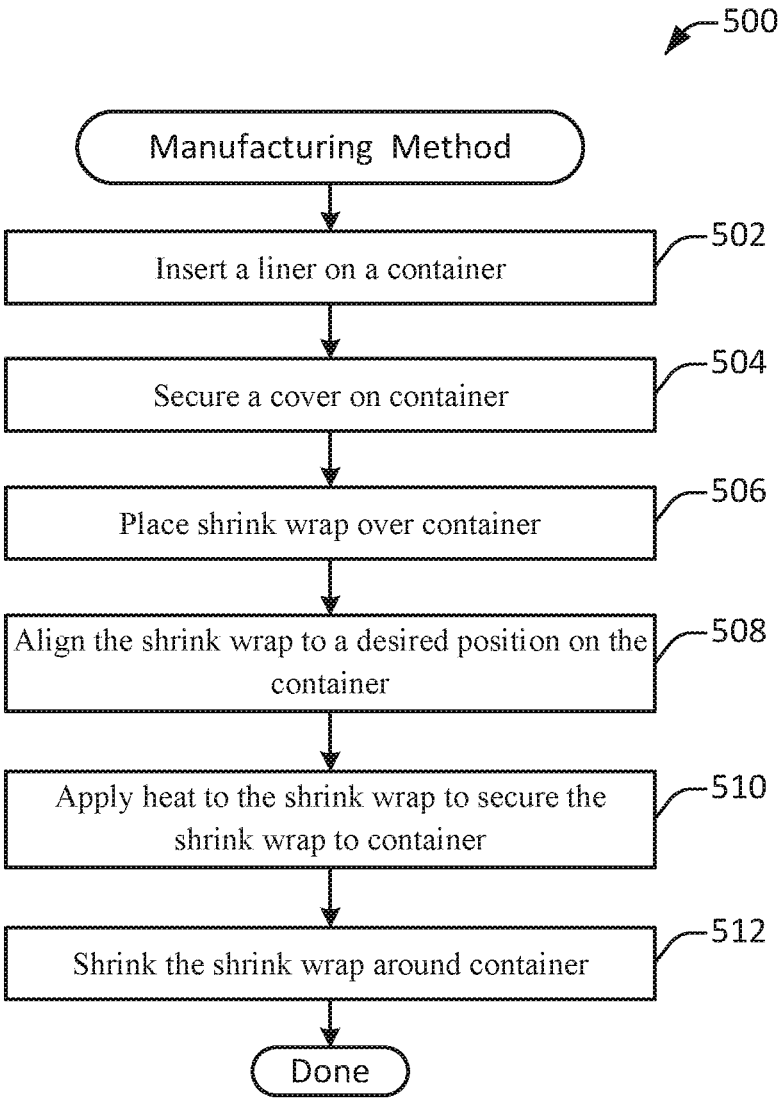
FIG. 5 depicts a simplified flowchart of a manufacturing process according to some embodiments.

FIG. 5 depicts a simplified flowchart 500 of a manufacturing process according to some embodiments. At 502, the process inserts a liner 108 on a container 102. At 504, the process secures a cover 106 on container 102, which places cover 102 over liner 108.

At 506, the process places shrink wrap seal 110 over container 102. At 508, aligners 406 align shrink wrap seal 110 to a desired position on container 102. At 510, the process applies heat to shrink wrap seal 110 to secure shrink wrap seal 110 to container 102. Then, at 512, the process shrinks shrink wrap seal 110 around container 102.

CONCLUSION

Container 102 is manufactured using a process that ensures shrink wrap seal 110 is not shown below cap 112. This improves the look and feel of container 102. Also, the manufacturing process is improved in that shrink wrap seal 110 is consistently placed in the right position.

As used in the description herein and throughout the claims that follow, "a", "an", and "the" includes plural references unless the context clearly dictates otherwise. Also, as used in the description herein and throughout the claims that follow, the meaning of "in" includes "in" and "on" unless the context clearly dictates otherwise.

The above description illustrates various embodiments along with examples of how aspects of some embodiments may be implemented. The above examples and embodiments should not be deemed to be the only embodiments, and are presented to illustrate the flexibility and advantages of some embodiments as defined by the following claims. Based on the above disclosure and the following claims, other arrangements, embodiments, implementations, and equivalents may be employed without departing from the scope hereof as defined by the claims.

What is claimed is:

1. A method for manufacturing a container, the method comprising:

placing a cover on the container;

placing shrinkable material on the container and the cover, wherein the shrinkable material includes a tamper indicator;

aligning the shrinkable material at a position on the container using an aligner;

applying heat to a portion of the shrinkable material, wherein the heat is configured to shrink the portion of the shrinkable material to hold the shrinkable material in the position;

shrinking the shrinkable material around the container and the cover; and placing a cap over the shrinkable material, wherein the cap covers the shrinkable material such that the shrinkable material is not visible below the cap.

2. The method of claim 1, further comprising:

placing a liner that is inserted in between the cover and a rim of the container.

3. The method of claim 1, wherein:

the portion comprises a first portion, the heat that is applied to the first portion of the shrinkable material is focused on the first portion and not a second portion of the shrinkable material.

4. The method of claim 3, wherein shrinking the shrinkable material comprises:

applying heat to the first portion and the second portion of the shrinkable material to shrink the first portion and the second portion.

5. The method of claim 4, wherein:

a first machine applies heat to the first portion, and a second machine applies heat to the first portion and the second portion.

6. The method of claim 1, wherein aligning the shrinkable material at the position comprises:

positioning a top of the aligner at the position, wherein the top of the aligner contacts the shrinkable material as the shrinkable material is placed on the container.

7. The method of claim 1, wherein the aligner comprises a belt that contacts the container at the position.

8. A container comprising:

a cover placed on the container;

shrinkable material that is placed on the container, wherein the shrinkable material is shrunk around the container and the cover, and wherein the shrinkable material includes a tamper indicator;

a cap placed over the shrinkable material, wherein the cap covers the shrinkable material such that the shrinkable material is not visible below the cap.

9. The container of claim 8, wherein the shrinkable material is aligned in a position on the container when the shrinkable material is placed on the container.

10. The container of claim 9, wherein an aligner is used to stop the shrinkable material at the position as the shrinkable material is placed on the container.

11. The container of claim 8, further comprising:

a liner that is inserted in between the cover and a rim of the container.

12. The container of claim 11, wherein the liner is secured by the cover and not sealed to the container.

13. The container of claim 8, wherein the tamper indicator comprises a perforation.

14. The container of claim 8, wherein the tamper indicator is activated upon movement of the shrinkable material.

15. The container of claim 8, wherein the tamper indicator breaks to allow the shrinkable material to be removed from the container.

16. The container of claim 8, wherein:

the container includes a first set of threads, the cap includes a second set of threads, wherein the cap is screwed onto the container using the first set of threads and the second set of threads without activating the tamper indicator.

17. The container of claim 16, wherein the shrinkable material is placed over the first set of threads.

18. The container of claim 8, wherein:

the cover is a same diameter of the container, and the shrinkable material is shrunk to the diameter.

19. The container of claim 8, wherein the shrinkable material comprises shrink wrap.

20. The container of claim 8, wherein the container comprises a glass material.

* * * * *